United States Patent [19]

Shoji et al.

[11] Patent Number: 4,900,330

[45] Date of Patent: Feb. 13, 1990

[54] PROCESS FOR PRODUCING A HIGH CONCENTRATION COAL-WATER SLURRY

[75] Inventors: Kazunori Shoji; Yoshinori Ohtani, both of Kure; Hirofumi Kikkawa; Hiroshi Terada, both of Hiroshima; Masayasu Murata, Hasuda; Nobuyasu Meguri, Kure, all of Japan

[73] Assignee: Babcock-Hitachi Kabushiki-Baisha, Tokyo, Japan

[21] Appl. No.: 11,394

[22] Filed: Feb. 4, 1987

Related U.S. Application Data

[63] Continuation-in-part of Ser. No. 760,626, Jul. 30, 1985, abandoned.

[30] Foreign Application Priority Data

Jul. 30, 1984 [JP] Japan ..... 59-159717

[51] Int. Cl.[4] ..... G10L 1/32

[52] U.S. Cl. ..... 44/51; 241/21; 241/34

[58] Field of Search ..... 44/51; 241/21, 34

[56] References Cited

U.S. PATENT DOCUMENTS

| | | | |
|---|---|---|---|
| 2,824,701 | 2/1958 | Vester et al. | 241/21 |
| 3,255,975 | 6/1966 | Molin et al. | 241/34 |
| 3,351,293 | 11/1967 | Meisel | 241/21 |
| 4,358,293 | 11/1982 | Mark | 44/51 |
| 4,465,495 | 8/1984 | Scheffee | 44/51 |
| 4,472,170 | 9/1984 | Hellyer | 44/51 |
| 4,481,015 | 11/1984 | Lusch et al. | 241/34 |
| 4,496,367 | 1/1985 | Mathiesen et al. | 44/51 |
| 4,515,602 | 5/1985 | Keller, Jr. et al. | 44/51 |
| 4,521,218 | 6/1985 | Greenwald, Sr. | 44/51 |
| 4,706,892 | 11/1987 | Klose | 241/34 |

*Primary Examiner*—William R. Dixon, Jr.
*Assistant Examiner*—Margaret B. Medley
*Attorney, Agent, or Firm*—Fay, Sharpe, Beall, Fagan, Minnich & McKee

[57] ABSTRACT

A process for continuously and automatically producing a high concentration coal-water slurry having a uniform quality is provided, which process comprises always monitoring the viscosity, concentration, pH, particle diameter distribution and the like of the slurry, detecting the variations of the foregoing and adjusting the quantity of coal fed, the quantity of water fed and the quantities of a surfactant and a pH adjustor added to thereby control the specifications of the coal-water slurry to definite ones.

18 Claims, 7 Drawing Sheets

FIG.12
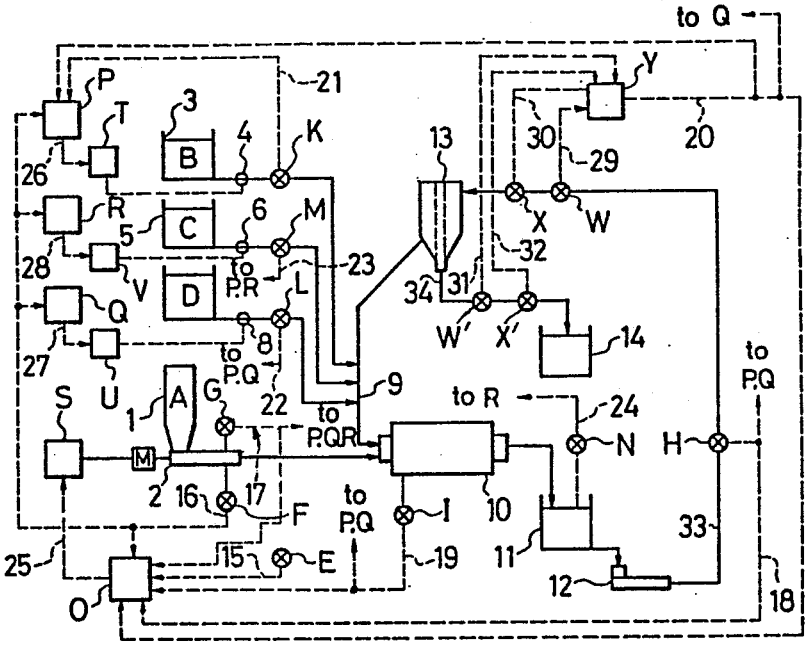
FIG.13A FIG.13B FIG.14
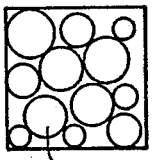
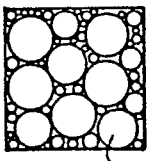
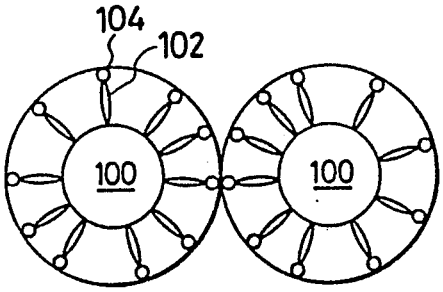

PROCESS FOR PRODUCING A HIGH CONCENTRATION COAL-WATER SLURRY

This is a continuation in-part of co-pending application Ser. No. 760,626, filed on Jul. 30, 1985, now abandoned.

BACKGROUND OF THE INVENTION

1. Field of the Invention

This invention relates to a process for producing a high concentration coal-water slurry and more particularly it is directed to a controlling process for making uniform the quality of the produced slurry.

2. Description of the Prior Art

Coal has been considered as a petroleum substitute fuel in view of the energy situation in recent years. In order to expand its utilization, research and development directed to various utilization techniques therefor have been vigorously made. Coal, however, has a drawback in that its handling is troublesome due to solids. In order to overcome the drawback, coal-utilizing techniques in the form of slurries have been researched. Their representative examples are a mixed fuel of coal with oil, COM (Coal-Oil-Mixtures), a mixed fuel of coal with water, CWM (Coal-Water-Mixtures), etc. However, the coal conversion of COM is about 50% on the weight basis, whereas that of CWM is 100%; hence the latter has been noted.

CWM which is stable for a long time and whose direct spray combustion is possible, has coal concentrations of about 60% by weight or more, coal particle sizes of 200 meshes (74 μm) pass of about 70 to 80% by weight and slurry viscosities of about 2,000 cp or less. It is possible to produce CWM having such properties by (1) adjusting the particle size distribution of coal particles having a broad width to raise the size packing density of coal particles to thereby make the concentration of the resulting slurry higher, and (2) adding a suitable surfactant and pH adjustor to coal particles to make the particle surface hydrophilic, adjust the surface potential of particles and disperse particles in stabilized manner through repelling of particles against one another to thereby make the viscosity of the resulting slurry lower. This will be described referring to the accompanying drawings. FIG. 13A and 13B illustrate this in a model manner. FIG. 13A illustrates a coal slurry of coal particles 100 having a narrow particle size distribution and FIG. 13B illustrates that having a broad particle size distribution. It is seen that the packing in the case of FIG. 13B is denser than that in the case of FIG. 13A. Further FIG. 14 illustrates a state wherein a surfactant having a hydrophobic group 102 and a hydrophilic group 104 functions upon coal particles 100 to effect making the particles hydrophilic through formation of a water layer and dispersing the particles by means of charge. In order to continuously produce CWM having a uniform quality as fuel, it is indispensable in the apparatus production to always adjust to adequate proportions, the quantity of coal fed, the quantity of water fed, and the quantities of a surfactant and a pH adjustor added. Further, coal is not of a uniform substance, and even in the case of coal mined from the same seam, its properties, particularly grindability and intrinsic moisture vary depending on each lot. Furthermore, even after it is dug, the surface moisture of coal varies depending on environmental changes and its pH varies due to oxidation. Thus, there has been a need for a controlling process capable of continuously producing a CWM having a uniform quality by rapidly corresponding to variations of factors having effects upon such properties of CWM.

The object of the present invention is to provide a controlling process which overcomes the technical problems of production of a high concentration coal-water slurry to thereby make it possible to continuously produce a high concentration coal-water slurry having a uniform quality.

SUMMARY OF THE INVENTION

In brief, the present invention resides in a process for producing a high concentration solid fuel-water slurry which comprises always monitoring the viscosity, concentration, pH, particle size distribution and the like of the slurry, detecting the variations of the foregoing and adjusting the quantity of solid fuel fed, the quantity of water fed and the quantities of a surfactant and a pH adjustor added, to thereby control the specifications of the solid fuel-water slurry. As for the solid fuel, coal and/or petroleum coke are preferably employed.

BRIEF DESCRIPTION OF DRAWINGS

FIG. 2 shows a view illustrating the relationship between particle size and percentage cumulative weight, while FIGS. 3A and 3B each show a typical view illustrating the milling state of coal resulting from the difference in coal concentration.

FIG. 12 shows an explanatory view illustrating the constitution Example of the present invention.

FIGS. 13A and 3B show a typical view illustrating the respective dispersion states of a coal-water slurry having a broad particle size distribution and that having a narrow one.

FIG. 14 shows a view which illustrates, in a model manner, making coal particles hydrophilic through the formation of a water layer and the dispersing coal particles by charge.

DETAILED DESCRIPTION OF THE PREFERRED EMBODIMENTS

Figure 1:
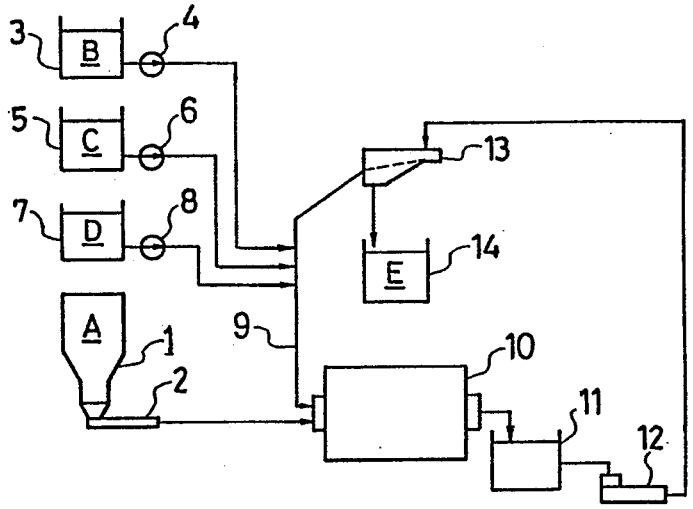
FIG. 1 shows an explanatory view illustrating the constitution of a CWM production apparatus.

Examples of the present invention will be concretely described referring to the drawings. FIG. 1 shows a constitution example of an apparatus for producing CWM. In FIG. 1, coal A stored in a bunker for raw coal 1 is fed via a coal feeder 2 to a wet ball mill 10. Into this mill, there are at the same time fed water B from a water tank 3 via a water pump 4, further a pH adjustor C from a tank for pH adjustor 5 via a pump for pH adjustor 6, and further a surfactant D from a tank for surfactant 7 via a pump for surfactant 8. Coal fed into the wet ball mill 10 is ground and mixed together with water, the surfactant and the pH adjustor to form a coal-water slurry which is then discharged into a slurry tank 11. The slurry once stored in the slurry tank 11 is carried by a pump 12 to a coarse particle separatory 13 where coarse particles are removed, and the resulting slurry is stored in a product tank 14 as a product CWM. The coarse particles separated by the coarse particle separator are circulated via a liquid feed pipe 9 to the wet ball mill 10.

FIG. 1 shows a most representative constitution example of CWM production apparatus in the present invention, but the feeding manner of coal, water, surfactant and pH adjustor, etc. may be somewhat modified. For example, the surfactant may be added in two divided portions, one at the inlet of the wet ball mill and the other at the outlet thereof, and the coarse particle separator 13 may sometimes be omitted.

Important specifications among those of CWM fuel are the particle size distribution of coal and the viscosity and concentration of slurry, and it is important to always control these specifications to definite values. Thus it is important to always monitor these specifications and feed back them to thereby control the CWM production apparatus so that they can fall in definite ranges.

Figure 2:
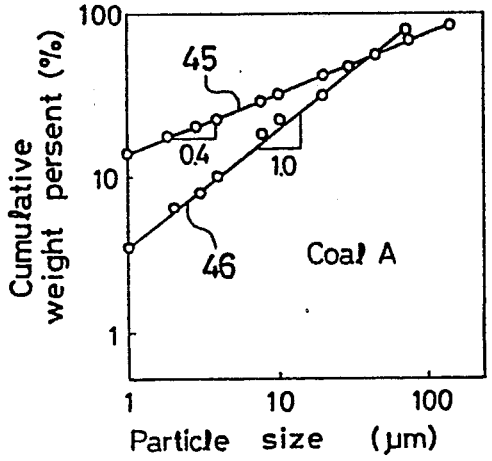
FIG. 2 and FIGS. 3A and 3B each show an explanatory view illustrating the effect of coal concentration at the time of milling upon particle size distribution.
Figure 3:
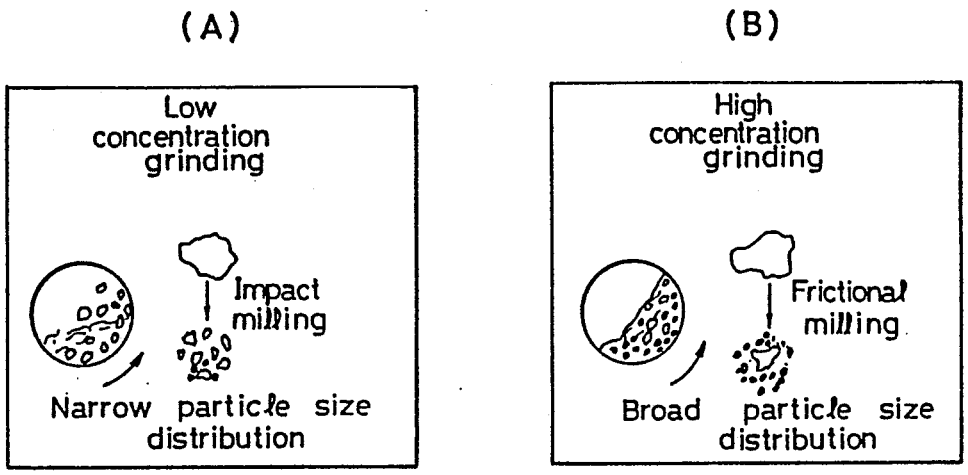

Thus, in order to grasp the effects of such factors upon the properties of the slurry, the present inventors made research on the grinding mechanism in the case where coal is wet-ground in an atmosphere of a high slurry concentration, employing a laboratory mill. At the same time, we carried out grinding tests of various kinds of coal having different properties, employing a CWM production system based on the flow sheet shown in FIG. 1. FIG. 2 shows results obtained when coal A (HGI=52) was subjected to wet, batch grinding so that 325 mesh pass (44 μm) could occupy 60% by weight under conditions of coal concentrations of 70% by weight and 50% by weight. In this FIG. 2, numeral 45 represents the case of 70% by weight and 46, the case of 50% by weight. When grinding was carried out in a high coal concentration of 70% by weight, 0.7% by weight of a surfactant (a compound of sodium naphthalenesulfonate group) and 0.1% by weight of NaOH, each based on coal were used, to obtain a broad particle size distribution (distribution modulus: 0.4), the slurry viscosity being 1,000 cp. When grinding was carried out in a coal concentration of 50% by weight, to obtain a particle size distribution having a narrow width (distribution index: 1.0) without using any surfactant, the slurry viscosity was 100 cp. This slurry was concentrated by dehydration into a coal concentration of 65% by weight and 0.7% by weight of a surfactant and 0.1% by weight of NaOH were added, but the slurry viscosity became 10,000 cp or higher to give no slurry having fluidity. On the other hand, grinding was attempted in a coal concentration of 70% by weight without adding any surfactant and NaOH, but the contents became an aggregate mass due to too high viscosity inside the mill to cause any flow; thus grinding did not proceed. Various types of coals having different properties were subjected to slurry formulation tests according to high concentration wet grinding. As a result, it was found that broad when particle size distributions (distribution modulus: 0.25~0.5) was achieved, it was possible to make the slurry concentration highest, although this depends on types of coal. It is considered that according to high concentration grinding, since the viscosity inside the mill is high, the grinding mechanism is changed from that ruled by impact grinding to that ruled by abrasive grinding, and hence the particle surface is scraped to form a large quantity of superfine powder and hence a broad particle diameter distribution (see FIG. 3).

Figure 4:
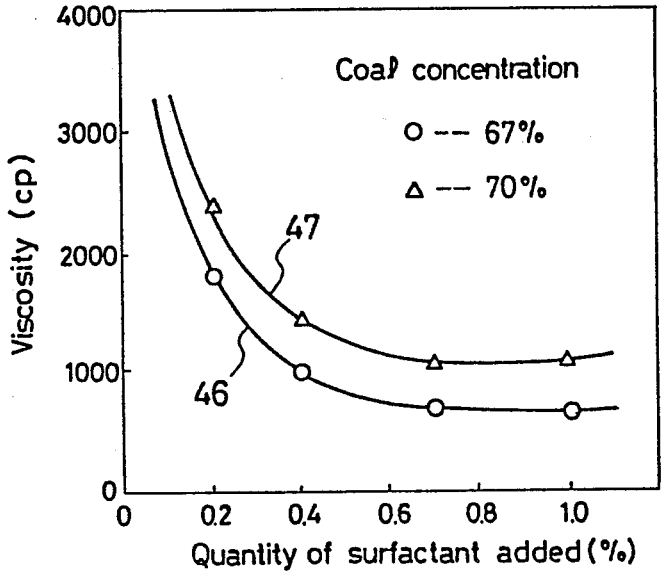
FIG. 4 shows an explanatory chart illustrating the effects of the quantity of surfactant added and the coal concentration upon the viscosity.

FIG. 4 shows the effects of the quantity of surfactant added and the coal concentration upon the viscosity of the slurry of coal A. In this figure, numeral 46 shows a case of a coal concentration of 67% and numeral 47, a case of a coal concentration of 70%. It is seen that in the same quantity of surfactant added, the lower the coal concentration, the lower the viscosity, and in the same coal concentration, the slurry viscosity lowers with the increase of the quantity of surfactant added, but when the quantity exceeds a definite one, the viscosity does not lower.

Next, the effect of slurry pH was studied.

Figure 5:
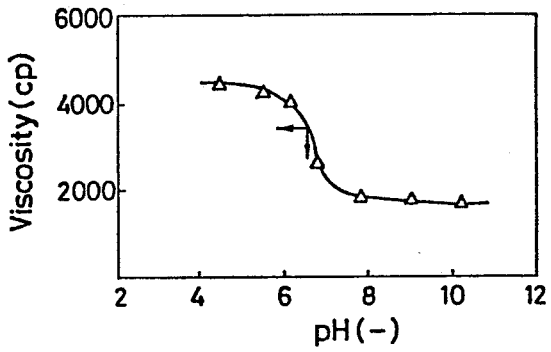
FIG. 5 shows an explanatory chart illustrating the effect of pH upon viscosity.

FIG. 5 shows the effect of pH upon the viscosity of the slurry of coal A (0.7% of a surfactant being contained). When the pH is lower than 7, the viscosity becomes about twice as high. Thus, it is seen that the pH is required to be 7 or higher, preferably in the range of 8 to 9.

From the above results; it was found that in order to produce a high concentration coal-water slurry by means of a wet ball mill, it is indispensable to grind coal in a state of high coal concentration and thereby obtain a broad particle size distribution, and in order to reduce the viscosity at the time of grinding it is also indispensable to use a surfactant and a pH adjustor, the quantity of surfactant added and the slurry pH each having an optimum value.

Figure 6:
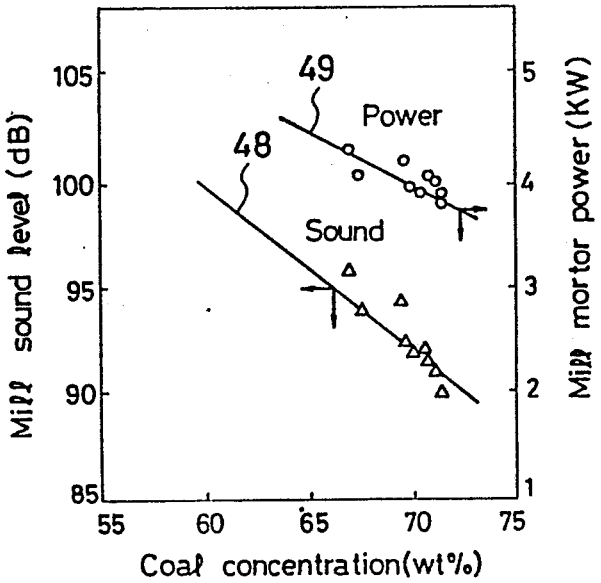
FIG. 6 shows an explanatory chart illustrating the relationships of the coal concentration with the driving power and the noise level of mill during grinding.
Figure 7:
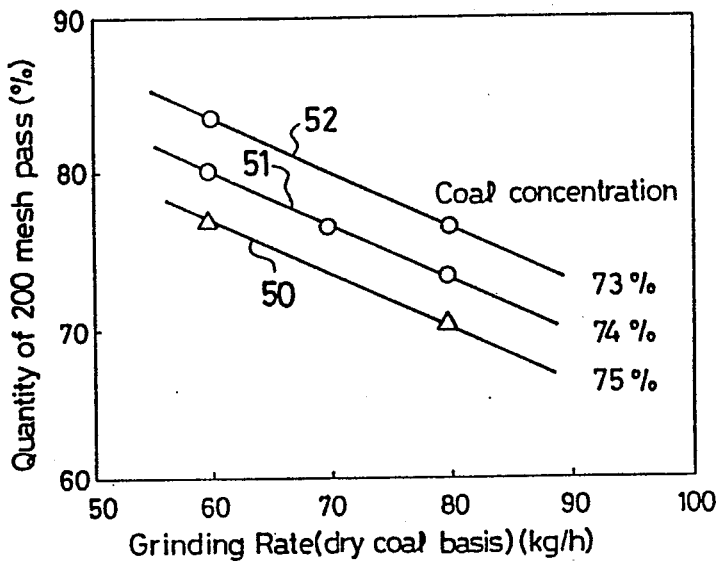
FIG. 7 shows an explanatory chart illustrating the relationships of the particle size with the quantity of coal ground and the coal concentration.

In grinding at such a high coal concentration, since the viscosity inside the mill is higher than that in the case of conventional wet grinding, (coal concentration: 30–50% by weight), the tumbling action of balls is retarded so that the collision mechanism of balls with one another or with the inner wall of the mill changes to a ball rolling (frictional) mechanism; hence the mill sound level and motor power decreases. FIG. 6 shows the relationships of the coal concentration with the mill-motor power and with the sound level during grinding. In this figure, numeral 48 shows the relationship between the concentration and the sound level, and 49 shows that between the concentration and the power. The reason that actually the mill power and the sound level decrease with the increase of the coal concentration is that the viscosity inside the mill increases. As a result, with the increase of the coal concentration i.e. the viscosity, the mill power decreases, the work done decreases and the ground particles become coarser. The grinding test results (FIG. 7) using coal B (HGI=67) show the said relationship. In this figure, numerals 50, 51 and 52 show the cases of coal concentrations of 75, 74 and 73% by weight, respectively. Namely, when the coal concentration increases in the same quantity of coal fed (dry coal basis), the slurry particles become coarse. This is a phenomenon that cannot occur in the case of conventional low concentration grinding. Further, it was found that at the same coal concentration, when the quantity of coal fed is increased, the particles become coarse as in the case of conventional wet grinding, since the retention time inside the mill is reduced.

Figure 8:
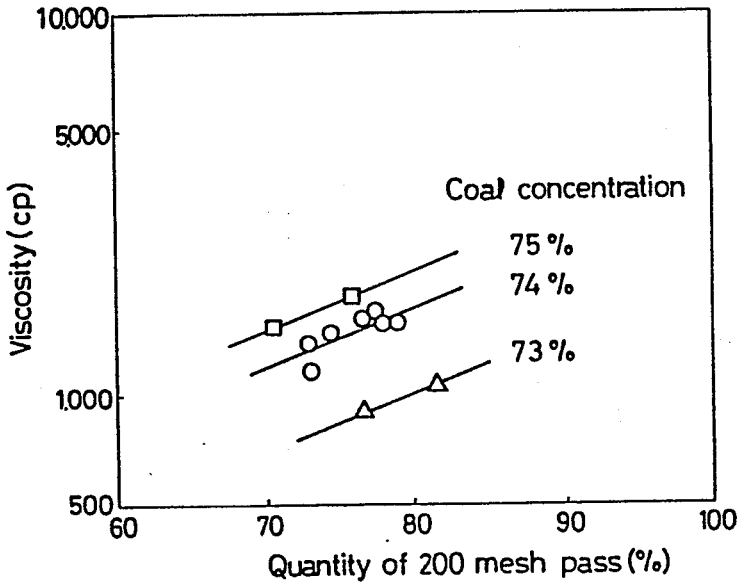
FIG. 8 shows an explanatory chart illustrating the relationship of the viscosity with the particle size and the coal concentration.

FIG. 8 shows the relationships of the viscosity with the concentration and the particle size, of the produced slurry. It is seen that the higher the coal concentration and also the smaller the particle size, the higher the viscosity.

Figure 9:
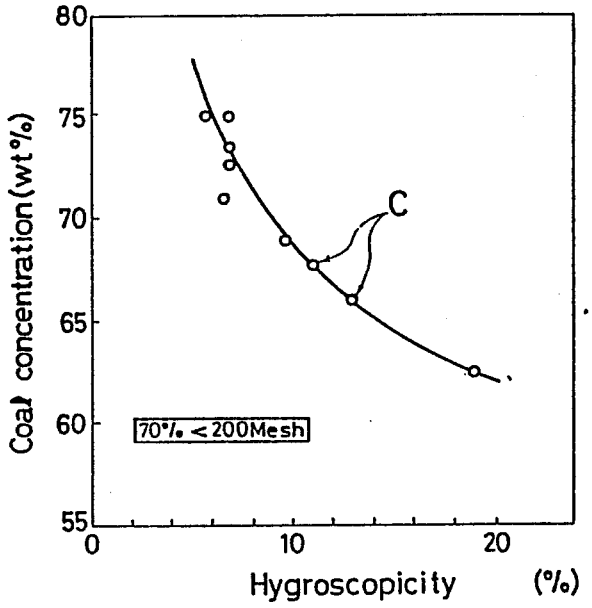
FIG. 9 shows an explanatory chart illustrating the relationship between the percentage of hygroscopicity and the coal concentration.

Next, the dependence of slurry properties on the type of coal used was studied. FIG. 9 shows the relationship of the hygroscopicity of coal (proportion in which coal absorbs water in the inside of its particles, water (g)/coal (g)) of coal (200 mesh pass: 70% by weight), with the coal concentration in the case of a slurry viscosity of 1,500 cp. It is seen that the coal concentration achieved depends greatly on the type of coal. Further, it was found that the percentage of water absorption is approximately proportional to the intrinsic moisture of coal. More interestingly, it was found that even in the case of the same type of coal, if the lots are different, the percentages of water absorption are different and the slurry properties also differ. In the case of coal C (HGI=37; C in FIG. 9), the percentage of water absorption increased from 11% to 13%, and the slurry concentration at the same viscosity also lowered from 68% to 66%.

Figure 10:
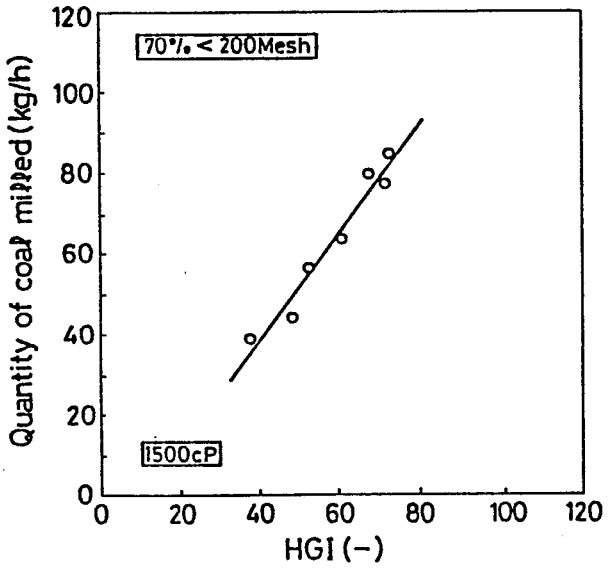
FIG. 10 shows an explanatory chart illustrating the relationship between the quantity of coal ground and HGI.

FIG. 10 shows the grindability characteristics of various types of coals in a wet ball mill of 650 $\phi \times 1{,}250$ L, in terms of the relationship between the milling capacity (dry coal basis) and HGI of coal (Hardgrove Grindability Index). From this figure it is seen that when HGI is different, the milling capacity is also different under conditions of the same quantity of 200 mesh pass and viscosity. Since coal is not a uniform substance, it may vary depending on lots even in the case of the same kind. According to Coal Grinding Technology (FE-2475, Dist. Category UC-90NTIS, U.S. Dept. of Commerce, Springfield, Va. U.S.A.), the deviation ranges from several 1% to 50% or more even in the case of the same kind of coal.

The above studies indicate that a number of factors influence the properties of a coal-water slurry produced by a high coal concentration wet grinding process. The results produced by variations in the optimal amounts of each factor on the properties of the slurry, as well as the interrelationships of all of the factors with one another are shown in Table 1. Similarly, the means for controlling the factors to offset changes produced by variations of any one factor are also collectively presented in Table 1.

It is particularly important to note that the total moisture of raw coal is the sum of the surface and intrinsic moistures of the coal. Since the total moisture content of raw coal effects the amount of coal added (i.e. the amount of coal needed is determined on a "dry weight basis" and the amount of raw coal actually added is determined by a "wet weight basis", wherein the raw coal added contains the additional weight of the surface and intrinsic moistures) and the viscosity of the concentration, the other variables must be adjusted to offset the effects produced by the variations in the surface and intrinsic moisture contents of the raw coal to produce a coal-water slurry having the desired uniform properties.

If the raw coal utilized has a relatively consistent moisture content, but varies in surface moisture content, then the other variables must be adjusted according to the control specifications set forth in Table 1.

For example, if the surface moisture of the raw coal increases while the intrinsic moisture remains constant, the wet ball mill will grind a lesser amount of coal at a lower concentration than that which is required to produce the coal-water slurry having the desired uniform properties resulting in a slurry of a lower concentration with finer particle sizes. This is because the amount of actual coal added contains not only coal but also the additional surface moisture. Since the amount of actual coal added is less than the amount needed to produce the desired slurry, the amount of raw coal added (wet basis) must be increased to account for the weight of the additional surface moisture. Similarly, the amount of water added must be reduced to take into account the additional surface moisture which is added with the coal.

On the other hand, if the surface moisture of the raw coal decreases while the intrinsic moisture remains unchanged, the wet ball mill will grind more coal than required, resulting in a slurry of higher concentrations (higher viscosity) with coarser particles sizes. In this case, the amount of water added must be increased and the amount of raw coal added (wet basis) reduced to produce a slurry with the desired uniform properties.

Furthermore, if the intrinsic moisture of raw coal increases while the total moisture is constant, the viscosity of the slurry in the wet ball mill increases although the mill grinds a predetermined amount of coal (dry basis) at a predetermined ratio of coal to water. This results in the slurry of coarser particle sizes. Therefore, the amount of water and surfactant added must be increased to reduce the viscosity in the mill.

On the other hand, if the intrinsic moisture of raw coal decreases while the total moisture remains unchanged, the viscosity in the mill decreases giving rise to finer particle sizes. In this case, the amount of water and surfactant added must be reduced to adjust the viscosity in the mill.

In reality, the total surface and/or intrinsic moisture content of raw coal varies greatly. However, it is only possible to measure the total moisture of raw coal, and the variations of surface or intrinsic moisture content of the raw coal cannot be detected. Therefore, in addition to measuring the total moisture of the coal, variations in the concentration, viscosity, and particle sizes must also be measured to detect changes in surface and intrinsic moisture. Once these changes have been detected, the factors can be adjusted accordingly to produce the desired uniform coal-water slurry.

Moreover, the grindability of raw coal in the wet ball mill must be constantly monitored and the other factors adjusted according to the control specifications set forth in Table 1 to produce a slurry with the desired uniform properties. If the grindability of raw coal in the high coal concentration wet grinding process becomes higher, the particle sizes become finer, resulting in the increase in viscosity. As a result of the increase in grindability of raw coal, the amount of raw coal added must be increased so as to give the required particle size distribution. Hence, the amount of water, surfactant, and pH adjustor must also be increased in proportion to the increment of coal added.

On the other hand, if the grindability of raw coal becomes lower, the particle sizes become coarser and the viscosity of slurry then decreases. The amount of coal, water, surfactant, and pH adjustor added must be decreased accordingly.

Finally, if the pH of raw coal becomes lower, the viscosity of the concentration increases, giving rise to coarser particle sizes. (See FIG. 5) The amount of pH adjustor must then be increased to reduce the viscosity of slurry in the mill. On the other hand, if the pH of raw coal becomes higher, no change in slurry properties may be observed and no action should be taken in general.

TABLE 1

| Influence factor | Variation | Phenomenon | Results | Control |
|---|---|---|---|---|
| Surface moisture[1] of raw coal | Increase[2] | Viscosity lowers. | Finer particle sizes | Amount of water fed, reduced; amount of coal fed (wet coal basis), increased so as to give a definite amount of dry coal. |
| | Decrease[2] | Viscosity increases. | Coarser particle sizes | Amount of water fed, increased; amount of coal fed (wet coal basis), reduced so as to give a definite amount of dry coal. |
| Intrinsic moisture[1] of raw coal | Increase[3] | Viscosity increases. | Coarser particle sizes | Amount of water fed, increased; surfactant, increased. |
| | Decrease[3] | Viscosity lowers. | Finer particle sizes | Amount of water fed, decreased. |
| HGI (Grind-ability) | Higher | Finer particle sizes | Viscosity increases. | Amount of coal fed and amount of water fed, increased; surfactant and pH adjustor, increased. |
| | Lower | Coarser particle sizes | Viscosity decreases. | Amount of coal fed amount of water fed, decreased; surfactant and pH adjustor, decreased. |
| pH of raw coal | Higher | No change | No change | None |
| | Lower | Viscosity, high | Coarser particle sizes | Amount of pH adjustor increased. |

Remarks:
[1]Total moisture = surface moisture + intrinsic moisture
[2]Variation of surface moisture while intrinsic moisture unchanged
[3]Variation of intrinsic moisture while total moisture unchanged Based on the above findings, the present inventors provide an operation-controlling process for keeping the product at a high quality, in the apparatus for continuously producing CWM.

Figure 11:
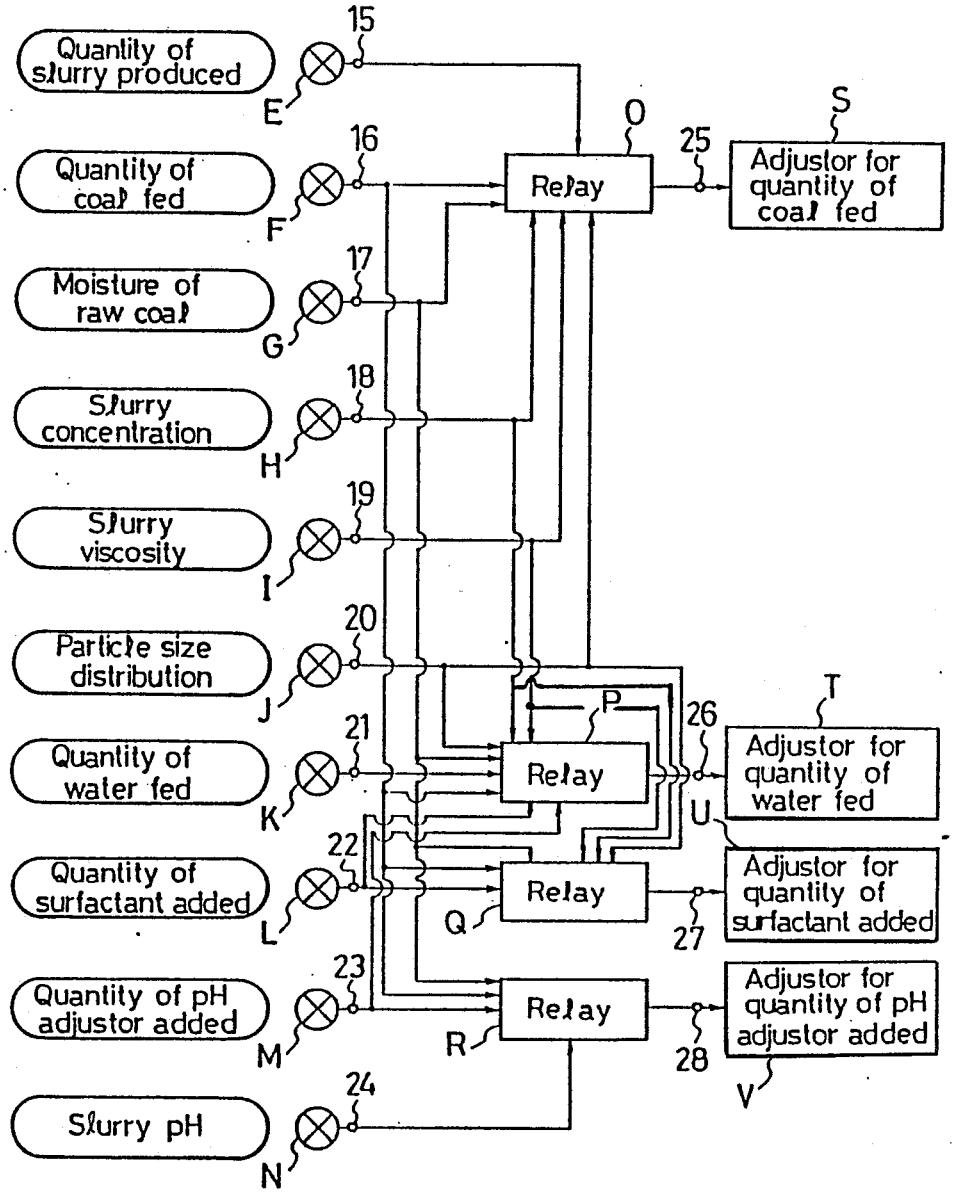
FIG. 11 shows a view of a controlling block of Example of the present invention.

FIG. 11 shows a control flow sheet illustrating an example of the operation-controlling process of the present invention. The wet ball mill is determined in size and designed by the specifications and the production quantity of product slurry depending on given coal. Thus if the production quantity of CWM is determined, the quantity of coal fed (dry coal basis) is determined. Further, correspondingly to this quantity of coal fed, the quantity of water fed and the quantities of surfactant and pH adjustor added are determined. These controlling elements will each be described below.

A signal 15 for the slurry production quantity is manually set by a setter E and correspondingly a signal 25 for the quantity of coal fed is transmitted to an adjustor S for the quantity of coal fed, to determine the quantity of coal fed. An actual quantity of coal fed is detected by a detector F and fed back to a relay O as a signal 16 for the actual quantity of coal fed (wet coal basis), and the moisture of raw coal is detected by a detector G and similarly fed back to the relay O as a signal 17 for the moisture of raw coal. If there is a deviation between the resulting quantity of coal fed and a set value thereof, the corresponding modified quantity is computed at the relay O, and transmitted as the signal 25 for the quantity of coal fed, to the adjustor S for the quantity of coal fed to modify the quantity of coal fed. On the other hand, the slurry concentration and viscosity and the particle size distribution are detected by detectors H, I and J, respectively, and fed back to the relay O as a signal 18 for the slurry concentration, a signal 19 for the slurry viscosity and a signal 20 for the particle size distribution, respectively. A modified quantity of coal fed is computed at the relay O, and the signal 25, for an adequate quantity of coal fed, based thereon, is sent to the adjustor S for the quantity of coal fed, to modify the quantity of coal fed.

As for the quantity of water fed, since this is proportional to the quantity of coal fed, the signal 16 for the quantity of coal fed (wet coal basis) and the signal 17 for the moisture of raw coal, each as an antecedent, are sent to a relay P, the quantity of water fed is computed from the quantity of coal fed and the moisture of coal carried in, and a signal 26 for the quantity of water fed is transmitted to an adjustor T for the quantity of water fed, to determine the quantity of water fed. The actual quantity of water fed is detected by a detector K and fed back to the relay P as a signal 21 for the actual amount of water fed, and the quantity of surfactant added and that of pH adjustor added are detected by detectors L and M, respectively and similarly fed back to the relay P as a signal 22 for the actual quantity of surfactant added and a signal 23 for the actual quantity of pH adjustor added, respectively. Thus, the actual quantity of water fed and the quantity of water carried in these added solutions are computed, and if there is a deviation between the quantity and a set value, the corresponding modified value is computed at the relay P and sent to the adjustor T for the quantity of water fed as the signal 26 for the quantity of water fed to modify the quantity of water fed. On the other hand, the slurry concentration and viscosity and the particle size distribution are detected by detectors H, I and J, respectively, and fed back to the relay P as the signal 18 for the slurry concentration, the signal 19 for the slurry viscosity and the signal 20 for the particle size distribution. The modified value of the quantity, of water fed is computed at the relay P, and the signal 26 for an adequate quantity of water fed, based thereon, is sent to the adjustor T for the quantity of water fed, to modify the quantity of water fed.

As for the quantity of surfactant added, since this is proportional to the quantity of coal fed, the antecedent signal 16 of the quantity of coal fed (wet coal basis) and that 17 of the moisture of raw coal are sent to a relay Q, and the quantity of coal fed (dry coal basis) is computed from the quantity of coal fed and the moisture of coal carried in, and further the signal 27 for the quantity of surfactant added, proportional thereto, is sent to an adjustor U for the quantity of surfactant added, to determine the quantity of surfactant added. Further, the actual quantity of surfactant added is detected by the detector L, and fed back to a relay Q as the signal 22 for the actual added quantity, and if there is a deviation between the above quantity and a set value, the corresponding modified quantity is computed at the relay Q and given to the adjustor U for the added quantity as the signal 27 for the quantity of surfactant added, to modify the added amount. On the other hand, the slurry concentration and viscosity and the particle size distribution are detected by the detectors H, I and J, respectively and fed back to the relay Q as the signal 18 for the slurry concentration, the signal 19 for the viscosity and the signal 20 for the particle size distribution. The modified quantity of the quantity of surfactant added is computed at the relay Q, and the signal 22 for an adequate quantity added, based thereon, is sent to the adjustor U for the quantity added, to modify the quantity added. If the kind of the surfactant is plural or if the surfactant is added at a plurality of locations, it is preferred to provide the detector L for the quantity of surfactant added, the relay Q and the adjustor U for the quantity added, each in a plural number.

Since the quantity of pH adjustor added is also proportional to the quantity of coal fed, the antecedent signal 16 for the quantity of coal fed (wet coal basis) and that 17 for the moisture of raw coal are sent to a relay R, an actual quantity of coal fed (dry coal basis) is computed at the relay R, and a signal 28 for the quantity of pH adjustor added, proportional thereto is sent to an adjustor V for the quantity of pH adjustor added, to determine the quantity added. The actual quantity of pH adjustor added is detected by a detector M and fed back to the relay R as the signal 23 for the actual quantity added, and if there is a deviation between the quantity and a set value, a modified quantity is computed at the relay R, and sent to the adjustor V for the quantity added, as the signal 28 for the quantity of pH adjustor added, to modify the quantity added. On the other hand, the slurry pH is continuously detected by a detector N, and fed back to the relay R as the signal 24 for the slurry pH. If there is a deviation between the pH values, a modified quantity of the quantity of pH adjustor added is computed at the relay R, and the signal 28 for an adequate quantity of pH adjustor added is sent to the adjustor V for the quantity added, to modify the quantity added.

FIG. 12 shows an explanatory view illustrating the concrete constitution of an example of the present invention. In this figure, coal A stored in a bunker for raw coal 1 is fed to a wet ball mill 10 by means of a coal feeder 2, where the quantity of coal fed (wet coal basis) is detected by a detector F, and its signal 16 is fed back to a relay O for the quantity of coal fed, a relay P for the quantity of water fed, a relay Q for the quantity of surfactant added and a relay R for the quantity of pH adjustor added. A signal 25 for the quantity of coal fed, from the relay O for the quantity of coal fed is sent to an adjustor S which modifies the quantity of coal fed. Here, as the detector F for the quantity of coal fed, the adjustor S and the coal feeder 2, a metering feeder equipped with a metering device such as gravimetric .feeder is preferable, but as the coal feeder and the adjustor, a screw feeder may be employed and as the detector, the speed of rotation of the feeder may be employed. Further, actually in order to put coal in the wet ball mill 10, it is preferred to provide a screw feeder after the metering feeder equipped with a metering device. Furthermore, in the coal feeder 2, the moisture of raw coal is detected by a detector G and its signal 17 is fed back to the relay O for the quantity of coal fed, the relay P for the quantity of water fed, the relay Q for the quantity of surfactant added and the relay R for the quantity of pH adjustor added. As the detector G for the moisture of raw coal, it is preferred to employ e.g. infrared ray moisture meter or high frequency moisture meter.

At the inlet of the wet ball mill 10 are fed water B from a water tank 3 via a water pump 4, a pH adjustor C from an adjustor tank 5 via an adjustor pump 6 and a surfactant D from a surfactant tank 7 via a surfactant pump 8. The quantity of water fed, from the water pump 4 is detected by a detector K for the quantity of water fed and a signal 21 for an actual quantity of water fed is fed back to the relay P for the quantity of water fed. The actual quantity of pH adjustor added, from the pH adjustor pump 6 is detected by a detector M, and its signal 23 is fed back to the relay P for the quantity of water fed and the relay R for the quantity of pH adjustor added. Further, an actual quantity of surfactant added is detected by a detector L, and its signal 22 is fed back to the relay P for the quantity of water fed and the relay Q for the quantity of surfactant added.

As for the detectors for the quantity of water fed and the quantities of surfactant and pH adjustor added, differential pressure flow meter or the like is suitable, and as the flow quantity adjustors T, U and V and the pumps 4, 6 and 8, flow-controllable pumps may be employed.

In the wet ball mill 10, coal A is ground and mixed together with water B, surfactant C and pH adjustor D, and discharged as a coal-water slurry, from the mill 10 into a slurry tank 11. Here, the slurry viscosity inside the mill 10 is indirectly detected by a detector I, and its signal 19 is fed back to the relay O for the quantity of coal fed, the relay P for the quantity of water fed, and the relay Q for the quantity of surfactant added. As previously described, if the milling conditions inside the mill (e.g. coal concentration) vary, the slurry viscosity inside the mill varies, and the mill-driving power and the sound level also vary (see FIG. 6). Thus, as the detector for measuring the slurry viscosity inside the mill, a torque meter for measuring the mill-driving torque, a watt meter for measuring the motor power or a noise meter is most preferable in order to effect rapid detection. Further, it is also effective to employ a combination of a torque meter or a watt meter with a noise meter. Since the retention time of the slurry inside the mill is long, the accommodation is delayed; thus, in place of detecting the viscosity of the slurry inside the mill, the viscosity of the slurry discharged from the mill may be detected whereby it is also possible to achieve the object.

The pH of the slurry discharged from the mill is detected by a detector N inside the tank 11, and its signal 24 is fed back to the relay R for the quantity of pH adjustor added. As the pH detector, a pH meter for general use may be employed. In place of detecting the pH inside the tank 11, it may be detected by an online pH meter in a transportation piping.

The slurry once stored inside the tank 11 is transported by a pump 12 to a coarse particle separator 13, and coarse particles separated there are circulated to the wet ball mill via a liquid feed pipe 9. The slurry of fine particle size passing through the coarse particle separator is stored in a product tank 14 as a product. The slurry concentration is detected by a detector H in the transportation piping, and its signal 18 is fed back to the relay O for the quantity of coal fed, the relay P for the quantity of water fed and the relay Q for the quantity of surfactant added. As the slurry concentration meter, $\gamma$-ray densimeter, twisted vibration type densimeter, etc. are suitable to use. Further, in place of detecting the slurry concentration in the piping, it may also be measured by detecting the static pressure difference of the slurry inside the tank 11.

The particle size of coal constituting the slurry may be sought by measuring the coal flow input (dry coal basis) into the cause particle separator 13 and the coal flow output (dry coal basis) of the slurry of fine particle size passing through the screen or mesh of the separator. Accordingly, the flow input into the coarse particle separator 13 is detected by a detector W for the slurry flow quantity, the slurry density is detected by a detector X, and their signals 29 and 30 are sent to a relay Y for the slurry particle size. Further, the flow output and density of the slurry as product passing through the coarse particle separator 13 are detected by the detectors W′ and X′ respectively, and their signals 31 and 32 are sent to the relay Y. In this relay Y, the particle size is computed based thereon, and a signal 20 for the particle size is sent to the relay O for the quantity of coal fed, the relay P for the quantity of water fed and the relay Q for the quantity of surfactant added. Further, in the case where not only the quantity of the slurry passing through a screen having a definite hole diameter and the quantity of the slurry remaining thereon, but also information concerning the particle size distribution over two points or more, is sought, this can be achieved by providing, in series, coarse particle separators having different screen hole diameters. As the flow meter, either one of volume type or mass type may be employed.

Thus, it is possible to operate the CWM production apparatus totally automatically. Further, by controlling the quantity of coal fed, the quantity of water fed, the quantity of surfactant and the quantity of pH adjustor, correspondingly to the variations of the operation conditions inside the wet ball mill, due to the change in the physical properties of raw coal, it is possible to keep the physical properties of CWM at a high quality. According to the Examples of the present invention, even when the grindability of raw coal varies, it is possible to keep the concentration, particle size and viscosity constant, and when the intrinsic moisture of coal (percentage of water absorption) varies, it is possible to keep the particle size and viscosity constant by varying the viscosity.

In the above Examples, as the antecedent signals of the quantity of water fed, the quantity of surfactant added and the quantity of pH adjustor added, the quantity of coal fed has been referred to, but as the antecedent signals, it is also possible to instead employ the slurry product quantity.

As the particle size analyzer, in place of the said method above, an on-line size analyzer (For example, Microtac analyzer) may be effectively employed in the pipeline 32 or 33, or the slurry tank 11 or 14.

According to the present invention, it is possible to subject a high concentration coal-water slurry to a totally automatic control, and it is also possible to keep the quality of the coal-water slurry at a definite one.

What we claim is:

1. A process for continuously producing by high coal concentration wet grinding a coal-water slurry having the desired uniform properties of a viscosity of 2,000 cp or less, a pH of 7 or more, and a coal particle concentration of at least 60% by weight with about 70 to 90% by weight of the coal particles sized so as to pass through a 200 mesh opening wherein said process comprises:

a. continuously wet grinding raw coal under conditions of high coal concentration to produce a coal-water slurry with broad coal particle size distribution;

b. continuously monitoring the viscosity, pH, coal particle concentration and the coal particle size distribution of the coal-water slurry;

c. continuously monitoring the quantity of coal fed, the moisture of coal fed, the quantity of water fed, the quantity of surfactant added and the quantity of pH adjustor added to the coal-water slurry;

d. continuously detecting the variations in the viscosity, pH, coal particle concentration and particle size distribution of the coal-water slurry from the desired properties; and e. continuously adjusting the quantity of coal fed, the quantity of water fed, the quantity of surfactant added and the quantity of pH adjustor added to the coal-water slurry to produce a coal-water slurry having the desired properties.

2. The process according to claim 1, wherein the continuous monitoring of the viscosity, pH, coal particle concentration and particle size distribution of the slurry are accomplished by detectors which generate electrical signals that are transferred to relays.

3. The process according to claim 1, wherein the continuous monitoring of the quantity of coal fed, the moisture of coal fed, the quantity of water fed, the quantity of surfactant added and the quantity of pH adjustor added to the slurry are accomplished by detectors which generate electrical signals that are transferred to relays.

4. The process according to claim 1, wherein the continuous determining of the variations in viscosity, pH, coal particle concentration and particle size distributions of the slurry from the desired properties are accomplished by relays which compare the information received from the detectors with the desired properties of the slurry; compute the modified amounts of coal, water, surfactant and pH modifiers needed to fulfill the desired properties of the slurry; and transfers the information concerning the modified amounts by electronic signals to adjustors.

5. The process according to claim 1, wherein the continuous adjusting of the quantity of coal fed, the quantity of water fed, the quantity of surfactant added and the quantity of pH adjustor added to the slurry to produce a coal-water slurry having the desired properties are accomplished by adjustors which add the modified amounts of coal, water, surfactant and pH modifiers as indicated by the electronic signals from the relays to produce a slurry having the desired properties.

6. A process for continuously producing by high coal concentration wet grinding, a coal-water slurry having the desired uniform properties of a viscosity of 2,000 cp or less, a pH of 7 or more, and a coal particle concentration of at least 60% by weight with about 70 to 90% by weight of the coal particles sized so as to pass through a 200 mesh opening, wherein said process comprises the following steps:

a. selecting and setting the desired quantity of coal-water slurry to be produced into a relay for the quantity of coal fed;
b. feeding a quantity of coal into a wet-ball mill by means of a coal feeder, wherein the actual amount of coal fed is determined by a detector which generates electrical signals that are transferred to the relays for the quantity of water fed, quantity of coal fed, for the quantity of surfactant added an for the quantity of pH adjustor added;
c. determining the moisture of the raw coal fed by a detector in the coal feeder which generates electronic signals that are transferred to he relay for the quantity of surfactant added, the relay for the quantity of coal fed, the relay for the quantity of pH adjustor added and to the relay for the quantity of water fed;
d. Feeding a quantity of water into the wet-ball mill, where the quantity of water fed is determined by a detector at the inlet of the wet-ball mill which generates an electronic signal that is transferred to the relay for the quantity of water fed;
e. Feeding a quantity of pH adjustor into the wet-ball mill, where the quantity of pH adjustor fed is determined by a detector at the inlet of wet-ball mill which generates electronic signals that are transferred to the relay for the quantity of water fed and to the relay for the quantity of the pH adjustor added;
f. feeding a quantity of surfactant into the wet-ball mill, where the quantity of surfactant is determined by a detector at the inlet of the wet-ball mill which generates electronic signals that are transferred to the relay for the quantity of water fed and to the relay for the quantity of surfactant added;
g. grinding and mixing the coal with the water, surfactant and pH adjustor, under conditions of high coal concentration and determining the slurry viscosity inside the wet-ball mill by a detector which generates electronic signals that are transferred to the relay for the quantity of coal fed, to the relay for the quantity of water fed, and to the relay for the quantity of surfactant added;
h. discharging the coal-water slurry inside the wet-ball mill into a slurry tank and determining the pH of the slurry in the slurry tank by a detector which generates an electronic signal that is transferred to a relay for the quantity of pH adjustor added;
i. transferring the slurry from the slurry tank to a coarse particle separator and determining the slurry concentration by a detector which generates an electric signal that is transferred to the relays for the quantity of coal fed, for the quantity of water fed, and for the quantity of surfactant added; and determining the flow input into the coarse particle separator by a detector for the slurry flow quantity which generates an electronic signal that is transferred to a relay for the slurry particle size, and determining the slurry density of the input slurry by a detector which generates an electronic signal that is transferred to the relay for the slurry particle size;
j. separating the coarse particles from the slurry in the coarse particle separator and returning to the wet-ball mill the coarse particles, and passing the remaining slurry of fine particles through the coarse particle separator into a product tank and determining the flow output and density of the output slurry by two independent detectors, which generate electronic signals that are sent to the relay for slurry particle size wherein the particle size is computed and electronic signals are generated that are transferred to the relay for the quantity of coal fed, to the relay for the quantity of water fe and to the relay for the quantity of surfactant added; and
k. storing the remaining slurry of fine particle size in the product tank.

7. The process of claim 6, wherein the quantity of new coal to be fed is determined by a relay for the quantity of coal fed which receives electrical signals from, the detector of the actual quantity of coal fed, the detector for the slurry concentration, the detector for the slurry viscosity and the detector for the particle size distributions; compares the information received from these electrical signals with the selected quantity of coal-water slurry; and computes the modified quantity of new coal needed to fulfill the desired properties of the coal-water slurry which is then transferred by electrical signal to an adjustor for quantity of coal fed.

8. The process of claim 6, wherein the quantity of new water to be fed is determined by a relay for the quantity of water fed which receives electrical signals from the detectors of, the actual quantity of water added, the quantity of coal fed, the moisture content of the coal added, the quantity of surfactant added, the quantity of pH adjustor added, the slurry concentration, the slurry viscosity and the particle size distribution; compares the information received from these electrical signals with the selected quantity of coal-water slurry;

and computes the modified quantity of new water needed to fulfill the desired properties of the coal-water slurry, which is then transferred by electrical signal to an adjustor for the quantity of water fed.

9. The process of claim 6, wherein the quantity of new surfactant to be added is determined by a relay for the quantity of surfactant added which receives electrical signals from the detectors of, the actual quantity of surfactant added, the quantity of coal fed, the moisture content of raw coal, the slurry viscosity, the slurry concentration, and the particle size distribution; compares the information received from these electrical signals with the selected quantity of coal-water slurry; and computes the modified quantity of new surfactant needed to fulfill the desired properties of the coal-water slurry, which is then transferred by electrical signal to an adjustor for the quantity of surfactant added.

10. The process of claim 6, wherein the quantity of new pH adjustor to be added is determined by a relay for the quantity of pH adjustor added which receives electrical signals from the detectors of, the actual quantity of pH added, the moisture content of raw coal, the quantity of coal fed and the slurry pH; compares the information received from these electrical signals with the selected quantity of coal-water slurry, and computes the modified quantity of new pH adjustor needed to fulfill the desired properties of the coal-water slurry, which is then transferred by electrical signal to an adjustor for the quantity of pH adjustor added.

11. The process of claim 6, wherein the coal feeder is a metering feeder selected from gravimetric feeder or screw feeder equipped with a metering device.

12. The process of claim 6, wherein the detectors for the quantity of water fed and the quantities of surfactant and the pH adjustor added are differential pressure flow meters.

13. The process of claim 6, wherein the adjustors for the quantity of water fed and the quantities of surfactant and pH adjustor added are flow-controllable pumps.

14. The process of claim 6, wherein the detector for measuring the slurry viscosity inside the mill is a torque meter for measuring the mill driving torque.

15. The process of claim 6, wherein the detector for the pH of the slurry is a pH meter.

16. The process of claim 6, wherein the detector for the slurry concentration is a densimeter.

17. The process of claim 6, wherein the entire continuous process is totally automatic.

18. An apparatus for continuously producing by high coal concentration wet grinding, a coal-water slurry having a viscosity of 2,000 cp or less, a pH of 7 or more, and a coal particle concentration of at least 60% by weight with about 70 to 90% by weight of the coal particles sized so as to pass through a 200 mesh opening; wherein said apparatus consists essentially of:

a. means for wet grinding raw coal under conditions of high coal concentration to produce a coal-water slurry with a broad coal particle size distribution;

b. means for detecting slurry viscosity, pH, coal particle concentration, and particle size distribution which generate electrical signals that are transferred to relays;

c. means for detecting the quantity of coal fed, the moisture of coal fed, the quantity of water fed, the quantity of surfactant added and the quantity of pH adjustor added which generates electrical signals that are transferred to relays;

d. relay means which received electrical signals from the detectors, compare the information received through these electrical signals with the selected quantity of coal-water slurry, and compute the modified quantities of coal, water, surfactant and pH modifies needed to fulfill the desired properties of the coal-water slurry which are then transferred by electrical signals to adjustors; and e. adjustor means which received electrical signals from the relay means, and adjust the amount of coal, water, surfactant and pH modifiers added to the wet grinding means as indicated by the electronic signals.

* * * * *